US006942408B2

(12) United States Patent
Smith

(10) Patent No.: US 6,942,408 B2
(45) Date of Patent: Sep. 13, 2005

(54) MARKING DEVICE, A METHOD OF USING THE SAME AND AN ACCESSORY KIT FOR THE MARKING DEVICE

(75) Inventor: Paul A. Smith, Glenview, IL (US)

(73) Assignee: Eversharp Pen Co., Franklin Park, IL (US)

( * ) Notice: Subject to any disclaimer, the term of this patent is extended or adjusted under 35 U.S.C. 154(b) by 0 days.

(21) Appl. No.: 09/510,087

(22) Filed: Feb. 22, 2000

(65) Prior Publication Data

US 2003/0185615 A1 Oct. 2, 2003

(51) Int. Cl.[7] ..... A46B 5/02; B43K 23/02; B43K 29/00

(52) U.S. Cl. ..... 401/6; 401/131; 401/195

(58) Field of Search ..... 401/6, 195, 131, 401/48

(56) References Cited

U.S. PATENT DOCUMENTS 1,134,691 A * 4/1915 Martin et al. ..... 401/131
1,367,872 A * 2/1921 Glaesser ..... 401/6
1,462,108 A * 7/1923 Holywell ..... 401/131
1,763,327 A * 6/1930 Richie ..... 401/6
2,173,451 A * 9/1939 Lorber ..... 401/6
D286,650 S * 11/1986 Fischer ..... D19/55
5,882,667 A * 3/1999 Jones ..... 424/405

* cited by examiner

*Primary Examiner*—David J. Walczak
(74) *Attorney, Agent, or Firm*—Patents+TMS, P.C.

(57) ABSTRACT

A marking device, a method of using the same and an accessory kit for a marking device having a sheath that may fit over a barrel of a marking device such as, for example, a pen or a pencil. Further, the marking device may contain an end cap having a connecting lead that may be attached to a surface, such as a surface on or near a computer or an automatic teller machine, for example. In addition, the sheath may contain an antimicrobial agent that may protect users of the sheath from disease-causing bacteria or other like agents.

8 Claims, 1 Drawing Sheet

10
12
14
16
18

72
70
60
66
68
56
73
62
64
52
50
58
54

72
70
100
52
50

104
102
100

MARKING DEVICE, A METHOD OF USING THE SAME AND AN ACCESSORY KIT FOR THE MARKING DEVICE

BACKGROUND OF THE INVENTION

The present invention generally relates to a marking device, a method of using the same and an accessory kit for a marking device. More specifically, the present invention relates to a marking device, a method of using the same and an accessory kit for a marking device that provide a sheath that fits over a marking device, such as, for example, a pen, and further relates to an end cap that fits on the end of the marking device. Further, the present invention relates to a marking device, a method of using the same and an accessory kit for a marking device that contains an antimicrobial substance on the sheath for sterilizing the sheath.

It is, of course, generally known to provide a marking device, such as, for example, a pen, a pencil or other like marking device. Further, it is known to design marking devices so that the devices are comfortable to hold. Of course, many writing instruments are difficult and/or uncomfortable to hold and, during use of the same, users often experience the development of calluses or like friction points on the hands or fingers of the users, particularly those fingers which grip the writing instrument. Further, often handicaps or other difficulties arise with certain individuals making it difficult or uncomfortable to hold or grip a writing instrument.

It is also generally known to provide a marking device in, for example, a public area, such as a school, an office, a hospital, a retail store or the like, that may be chained or otherwise connected to a permanent structure such as, for example, a desk or a wall. Many such marking devices are configured to have the chain or connecting device integrally formed and extending from the marking device through an end of the marking device. To remove the marking device from the chain, a link may be removed from the chain thereby separating the marking device and a certain length of chain from the remainder of the chain that is attached to the permanent structure. This may make it difficult to replace the marking device to the connecting device when the marking device no longer functions or otherwise is depleted of writing material such as, for example, ink.

Moreover, marking devices used in, for example, the aforementioned public areas are susceptible to contact with bacteria, viruses and/or other microbes on the surface of the marking device. Subsequent contact with the marking device by other individuals in a public area may increase the likelihood of exposure to the bacteria, viruses and/or the microbes thereby likely causing illness or disease to spread.

A need, therefore, exists for an improved marking device, a method of using the same and an accessory kit for a marking device that overcome the problems associated with known marking devices.

SUMMARY OF THE INVENTION

The present invention provides a marking device, a method of using the same and an accessory kit for a marking device. More specifically, the present invention provides a marking device, a method of using the same and an accessory kit for a marking device that provide an antibacterial sheath that fits over a barrel of the marking device and an end cap having a connecting chain attached thereto.

To this end, in an embodiment of the present invention, a marking device is provided. The marking device has a barrel and a sheath that fits over the barrel. An end cap is provided for fitting on an end of the barrel wherein the end cap has a connecting lead.

In an embodiment, the sheath is cylindrically shaped with an aperture therethrough.

In an embodiment, the sheath wraps around the barrel of the marking device.

In an embodiment, a clamp is provided for clamping the sheath to the marking device.

In an embodiment, an antibacterial substance is associated with the sheath.

In an embodiment, the connecting lead is a chain.

In an embodiment, the end cap is interchangeable between a plurality of barrels.

In an embodiment, means is provided for attaching the sheath to the barrel.

In another embodiment of the present invention, an marking device accessory kit is provided. The accessory kit includes a marking device having a barrel and a flat article wherein the article wraps around the barrel of the marking device.

In an embodiment, a clamp clamps the article to the marking device.

In an embodiment, an antimicrobial substance is associated with the article.

In an embodiment, the article wraps a plurality of times around the barrel creating a plurality of layers around the marking device.

In an embodiment, the article includes an adhesive for fixing the article to the barrel of the marking device.

In an embodiment, a tool is provided for attaching the clamps to the article.

In another embodiment of the present invention, a marking device accessory kit is provided. The kit includes a marking device having an end and an end cap fitting on the end of the marking device wherein the end cap is interchangeable between a plurality of marking devices. A connecting lead is connected to the end cap.

In an embodiment, the connecting lead is a chain.

In another embodiment, a method of using a marking device is provided. The method comprises the steps of: providing a barrel having an end; providing a sheath that fits over the barrel; providing an end cap for fitting over an end of the barrel wherein the end cap has a connecting lead; fitting the sheath over the barrel; and fitting the end cap over the end of the barrel.

In an embodiment, an antimicrobial substance is provided on the sheath.

In an embodiment, clamps are provided for clamping the sheath to the barrel of the marking device. The sheath is wrapped over the barrel of the marking device clamped to the barrel of the marking device.

In an embodiment, an adhesive on the sheath. The sheath is wrapped around the barrel of the marking device to form layers wherein the layers stick together and further to the marking device via the adhesive.

It is, therefore, an advantage of the present invention to provide a marking device, a method of using the same and an accessory kit for a marking device that provide a sheath that fits over a barrel of the marking device.

Another advantage of the present invention is to provide a marking device, a method of using the same and an accessory kit for a marking device having an end cap for fitting on the end of the marking device wherein the end cap has a connecting lead.

Yet another advantage of the present invention is to provide a marking device, a method of using the same and an accessory kit for a marking device having an antibacterial substance associated therewith.

Moreover, an advantage of the present invention is to provide a marking device, a method of using the same and an accessory kit for a marking device that have clamps to hold the sheath to the marking device.

A still further advantage of the present invention is to provide a marking device, a method of using the same and an accessory kit for a marking device having an interchangeable end cap connected to the connecting lead.

And, another advantage of the present invention is to provide a marking device, a method of using the same and an accessory kit for a marking device that provide a tool to aid in clamping the sheath to the marking device.

A further advantage of the present invention is to provide a marking device, a method of using the same and an accessory kit for a marking device that provide a barrel of the marking device with a sheath wrapped therearound and further having an adhesive material to hold the sheath on the barrel.

Moreover, another advantage of the present invention is to provide a marking device, a method of using the same and an accessory kit for a marking device that may be used in public areas and may decrease the potential of contact with and/or the spread of bacteria, viruses and/or other microbes.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figures 1, 2, 3, 4:
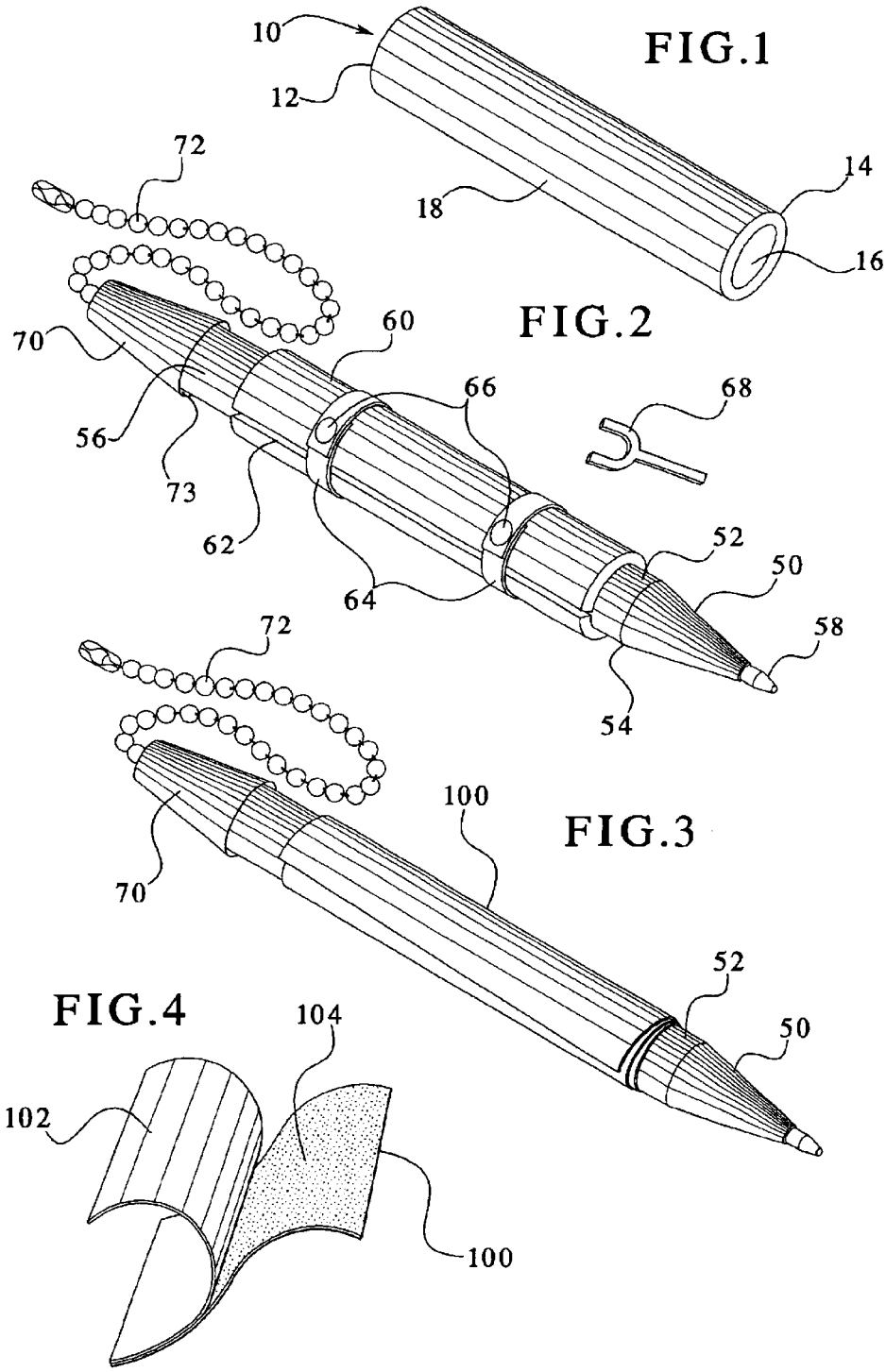
FIG. 1 illustrates a perspective view of a sheath for a barrel of a marking device in an embodiment of the present invention.
FIG. 2 illustrates a perspective view of a sheath having clamps and an end cap with a chain in an embodiment of the present invention.
FIG. 3 illustrates a perspective view of a sheath wrapped around the barrel of a marking device and an end cap with a chain in another embodiment of the present invention.
FIG. 4 illustrates a perspective view of a sheath, an adhesive and a protective layer in an embodiment of the present invention.

The present invention generally relates to a marking device, a method of using the same and an accessory kit for a marking device. More specifically, the present invention relates to a marking device that includes a sheath that fits over a marking device, such as, for example, a pen, and an end cap on an end of the marking device having a connecting lead. Still further, the present invention relates to a sheath having an antimicrobial substance associated therewith.

Referring now to the drawings wherein like numerals refer to like parts, FIG. 1 generally illustrates a sheath 10 that may fit over a barrel of a marking device. Generally, the sheath 10 may have a first end 12, a second end 14 and an aperture 16 for a barrel of a marking device to fit therethrough.

The sheath 10 may further have a surface 18 having an antimicrobial agent associated therewith. The antimicrobial agent may produce an actively sterile surface that kills bacteria, viruses and other like microbes and disease-causing agents. One known material that may be implemented as a coating to the sheath 10 of the present invention is Spir-Agent™ manufactured by Spire, Inc. The material may be incorporated via deposition technology, namely ion-beam assisted deposition (IBAD) to create an infection-resistant actively sterile coating. Of course, other means may be implemented to apply the antimicrobial agent to the surface 18 of the sheath 10. Further, the antimicrobial agent may be contained within the material used to construct the sheath 10 and not necessarily contained merely upon the surface 18 of the sheath 10.

Further, the sheath 10 may contain fingers along an entire length of the sheath 10 contained on an inside surface of the sheath 10. The fingers may allow the sheath 10 to grip the barrel of the marking device. Further, the fingers may provide spaces between the sheath 10 and the marking device to provide a cushion for a person as the person uses the sheath 10. Additionally, the sheath 10 may include a plurality of cells having air therein to provide a comfortable grip as the person uses the sheath 10. The antibacterial agent, the fingers on the inside surface of the sheath 10 and the plurality of cells are disclosed in U.S. Pat. No. 6,019,533, the disclosure of which is incorporated herein by reference in its entirety.

The sheath 10 may fit snugly on a barrel of a marking device, such as, for example, a pen, a pencil or other like marking device, that may be apparent to those skilled in the art. Further, the sheath 10 may be removable from the marking device for replacement purposes or for depositing more of the antimicrobial agent to the sheath 10.

FIG. 2 generally illustrates a marking device 50 having a barrel 52. The barrel 52 may have a first end 54 and a second end 56. The marking device 50 may be any device capable of producing a mark with a tip 58, such as a pen, a pencil or any other like marking device. The cross-sectional shape of the barrel 52 may be circular as shown in FIG. 2. However, the barrel 52 may have any other cross-sectional shape that may be apparent to those skilled in the art. For example, the cross-sectional shape of the barrel 52 may be square, triangular-shaped, multi-sided or any other shape that may be apparent to those skilled in the art. Further, the sheath 10, as shown in FIG. 1, may be designed to conform to any shape of the barrel 52.

Still referring to FIG. 2, the barrel 52 may have a sheath 60 secured thereon. The sheath 60 may have a split section 62 and further may have bands 64 that may be utilized to fasten over the sheath 60 to fix the sheath 60 to the barrel 52. The bands 64 may have screws 66 or other like fastening means that may be attached to the band 60 and utilized to tighten or clamp the bands 64 over the sheath 60. The bands 64 may have apertures for the screws 66 to fit therethrough. For example, as shown in FIG. 2, the bands 64 may have ends that overlap thereby allowing the apertures contained within the bands 64 to overlap as well. The screws 66 may fit through the apertures. Tightening of the screws 66 may tighten the sheath 60 to the barrel 52. Any number of bands may be utilized to fix or clamp the sheath 60 onto the barrel 52. Further, any connecting means may be utilized to tighten the bands 64 to the sheath 60 as may be apparent to those skilled in the art.

The sheath 60 may be a rectangular piece of material when laid on a flat surface but may wrap around the barrel 52 of the marking device 50 to be fixed in place by the bands 64. When placed around the barrel 52, the sheath 60 may partially cover the barrel 52. Moreover, when placed around the barrel 52, the sheath 60 may form the split 62 between two ends of the sheath 60. Alternatively, the two ends of the sheath 60 may overlap (not shown).

A tool 68 may be utilized to fasten the screws 66 onto the bands 64 thereby fixing or clamping the sheath 60 to the barrel 52. The tool 68 may be specially designed to aid in attaching the sheath 60 to the barrel 52 or may be any other tool that may aid in this process.

Further, the sheath 60 may contain the antimicrobial agent thereon to kill bacteria, viruses, fungi or any other like microbial substances or disease-causing substances as described in U.S. Pat. No. 6,019,533, the disclosure of which is incorporated by reference herein in its entirety.

Fixed on the second end 56 of the barrel 52 may be an end cap 70 having a connecting lead 72 extending therefrom. The end cap 70 may fit over the second end 56 of the barrel 52. The end cap 70 may have an opening 73 that is slightly larger than the width of the barrel 52. The end cap 70, therefore, may fit snugly over the second end 56 of the barrel 52 thereby fixing the end cap 70 to the marking device 50. Additionally, the end cap 70 may be constructed of a rubberized material having a degree of pliability that may allow the end cap 70 to fit over other shaped barrels. For example, the end cap 70 may have a generally circular-shaped opening 73. However, the end cap 70 may be pliable and may fit over the end of a triangular-shaped barrel or other shape barrel that may be apparent to those skilled in the art.

Alternatively, the end cap 70 may have screw threads therein. The screw threads may engage with screw threads that may be contained on the second end 56 of the barrel 52 thereby causing the end cap to become fixed to the second end 56 of the barrel 52. However, any other attaching means may be utilized to attach the end cap 70 to the marking device 50, and the present invention should not be construed as limited in any way as herein described. Any attaching means may be utilized to connect the end cap 70 to the marking device 50 that may be apparent to those skilled in the art.

The connecting lead 72 may extend from the end cap 70 and may be integrally formed with the end cap 70. However, the connecting lead 72 may extend from a hole contained on an end of the pen cap 70 (not shown). The connecting lead 72 may be a chain, a rope, or any other like connecting apparatus that may be apparent to those skilled in the art. The connecting lead 72 may connect to any surface, such as, for example, a wall, an ATM machine, a desk or any other like surface.

In use, the marking device 50 may be fit with the sheath 60 that may be fixed to the barrel 52 via the bands 64 and the screws 66. The bands 64 and the screws 66 may be attached via the tool 68. The sheath 60 may thereby allow a comfortable grip to be placed onto the marking device 50 and further may provide a substance that kills disease-causing agents thereby allowing the marking device 50 to be used in public places without fear of contracting bacteria, viruses and/or disease. Further, the marking device 50 may be attached to the end cap 70 with the connecting lead 72 further attached to an immovable surface such as, for example, a computer or ATM machine or any other like area, that may require a marking device 50 to provide security to the marking device 50.

Referring now to FIG. 3, the marking device 50 is further illustrated having the end cap 70, the connecting lead 72 and a sheath 100 that may be wrapped around the barrel 52 of the marking device 50. The sheath 100 may be generally rectangular-shaped when laid on a flat surface but may conform to the shape of the barrel 52 when wrapped therearound. Therefore, the sheath 100 may conform to any size and shape barrel 52 that may be apparent to those skilled in the art.

As shown in FIG. 4, one side of the sheath 100 may contain an adhesive 104 that may be utilized to adhere the sheath 100 to the marking device 50. When the sheath 100 has been wrapped around the barrel 52 of the marking device 50, the adhesive 104 may render the sheath 100 relatively immovable. The sheath 100 may be unwrapped from the marking device 50 for purposes of replacement when worn or when the sheath 100 has otherwise lost its effectiveness. Alternatively, the adhesive 104 may permanently adhere the sheath 100 to the barrel 52.

Alternatively, the sheath 100 may be composed of a non-adhesive material that may allow the sheath 100 to stick to itself, the barrel 52 or any other like surface. When wrapped around the barrel 52 of the marking device 50, the sheath 100 may attach to the barrel 52 and to itself. The sheath 100 may also contain the antimicrobial agent thereon or otherwise associated therewith.

Before the sheath 100 has been wrapped around the marking device 50, a protective layer 102 may be provided on one side of the sheath 100 to protect the adhesive 104 that may be contained thereon as shown in FIG. 4. A user may then peel the protective layer 102 from the adhesive 104 on the sheath 100 and thereafter wrap the sheath 100 around the barrel 52 of the marking device 50.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A marking device accessory kit, the accessory kit comprising:

a marking device having a barrel defined between a first end and a second end wherein the first end has a tip capable of producing a mark;

a flat article placed around the barrel to partially cover the barrel of the marking device;

a band secured around the flat article to hold the flat article on the barrel; and a cap having a lead extending from the cap wherein the cap is removably attached to the barrel at the second end.

2. The accessory kit of claim 1 further comprising:

an antimicrobial substance associated with the article.

3. The accessory kit of claim 1 further comprising:

a tool for attaching the band to the article.

4. A marking device accessory kit, the accessory kit comprising:

a marking device having a barrel having an exterior surface wherein the barrel is defined between a first end and a second end wherein the first end has a tip capable of producing a mark and further wherein the marking device has a means for producing the mark within the barrel;

a sheath having an area defined within exterior edges and further defined by an inside surface and an outside surface wherein the inside surface is continuously coated with an adhesive to cover the area within the exterior edges and further wherein the sheath wraps around the exterior surface of the barrel of the marking device wherein the inside surface of the sheath overlaps onto the outside surface of the sheath when wrapped around the exterior surface of the marking device and further wherein the inside surface of the sheath attaches to the exterior surface of the barrel of the marking device and the outside surface of the sheath via the adhesive;

an end cap removably attached to the second end of the barrel wherein the end cap is interchangeable between a plurality of marking devices; and a connecting lead having a first end and a second end wherein the first end of the connecting lead extends from the end cap and is removably connected to the end cap.

5. The accessory kit of claim 4 wherein the connecting lead is a chain.

6. A method of using a marking device, the method comprising the steps of:

providing a barrel having an exterior surface and further having a body defined between a first end and a second end wherein the first end has a tip capable of producing a mark wherein a means for producing the mark is within the barrel;

providing a sheath that overlaps onto itself when wrapped around the exterior surface of the barrel and partially covers the exterior surface of the barrel between the first end and the second end wherein the sheath is coated with an antimicrobial substance;

providing a band secured around the sheath to hold the sheath on the barrel;

providing an end cap for fitting over the second end of the barrel wherein the end cap has a connecting lead that extends from the end cap;

fitting the sheath over the barrel between the first end and the second end; and fitting the end cap over the second end of the barrel.

7. A method of using a marking device, the method comprising the steps of:

providing a barrel having a body defined between a first end and a second end wherein the first end has a tip capable of producing a mark;

providing a sheath that partially covers the barrel between the first end and the second end wherein the sheath is coated with an antimicrobial substance;

providing an end cap for fitting over the second end of the barrel wherein the end cap has a connecting lead that extends from the end cap;

fitting the sheath over the barrel between the first end and the second end;

fitting the end cap over the second end of the barrel;

providing clamps for clamping the sheath to the barrel of the marking device;

wrapping the sheath over the barrel of the marking device; and clamping the sheath to the barrel of the marking device.

8. A method of using a marking device, the method comprising the steps of:

providing a barrel having an exterior surface and further having a body defined between a first end and a second end wherein the first end has a tip capable of producing a mark wherein a means for producing the mark is within the barrel;

providing a sheath that overlaps onto itself when wrapped around the exterior surface of the barrel and partially covers the exterior surface of the barrel between the first end and the second end wherein the sheath is coated with an antimicrobial substance;

providing an end cap for fitting over the second end of the barrel wherein the end cap has a connecting lead that extends from the end cap;

fitting the sheath over the barrel between the first end and the second end;

fitting the end cap over the second end of the barrel;

providing clamps for clamping the sheath to the barrel of the marking device;

wrapping the sheath over the barrel of the marking device; and clamping the sheath to the barrel of the marking device.

* * * * *